United States Patent [19]

Batchelder

[11] 4,123,858

[45] Nov. 7, 1978

[54] VERSATILE SUBMERSIBLE DEVICE FOR DREDGING OR OTHER UNDERWATER FUNCTIONS

[76] Inventor: George W. Batchelder, 960 E. Jackson Blvd., Elkhart, Ind. 46514

[21] Appl. No.: 818,525

[22] Filed: Jul. 25, 1977

Related U.S. Application Data

[63] Continuation-in-part of Ser. No. 740,117, Nov. 8, 1976, abandoned, which is a continuation of Ser. No. 651,527, Jan. 22, 1976, abandoned, which is a continuation of Ser. No. 517,469, May 14, 1975, abandoned, which is a continuation of Ser. No. 469,930, Apr. 15, 1974, abandoned, which is a continuation of Ser. No. 369,925, Jun. 14, 1973, abandoned, which is a continuation of Ser. No. 161,348, Jul. 6, 1971, abandoned.

[51] Int. Cl.[2] ..... E02F 3/88

[52] U.S. Cl. ..... 37/56; 37/60; 37/63; 37/64; 37/73; 405/194; 114/333; 137/236 S

[58] Field of Search ..... 37/56, 58, 72, 73, 61–63, 37/DIG. 8, 65, 64; 61/69 R, 69 A; 114/16 E; 9/8 P; 137/236; 302/14

[56] References Cited

U.S. PATENT DOCUMENTS

| | | | |
|---|---|---|---|
| 813,935 | 2/1906 | Avery, Jr. | 37/56 |
| 885,930 | 4/1908 | Lake | 37/56 |
| 1,228,300 | 5/1917 | Deemer | 61/69 R |
| 1,380,750 | 6/1921 | Tesch | 61/69 R |
| 2,029,858 | 2/1936 | Couch | 37/65 UX |
| 2,308,437 | 1/1943 | Becker | 37/65 |
| 2,519,453 | 8/1950 | Goodman | 61/69 R |
| 2,585,712 | 2/1952 | Wiggins, Jr. | 61/69 R |
| 3,080,583 | 3/1963 | Fuller | 9/8 P |
| 3,369,368 | 2/1968 | Wilson | 61/69 R |
| 3,415,068 | 12/1968 | Casey, Jr. et al. | 37/56 X |
| 3,522,670 | 8/1970 | Flipse et al. | 37/DIG. 8 |
| 3,620,572 | 11/1971 | Krutein | 37/56 X |
| 3,812,922 | 5/1974 | Stechler | 37/56 X |
| 3,851,491 | 12/1974 | Mason | 61/69 R |
| 3,892,079 | 7/1975 | Hirano et al. | 37/56 |

FOREIGN PATENT DOCUMENTS

| | | | |
|---|---|---|---|
| 994,626 | 6/1965 | United Kingdom | 37/56 |

*Primary Examiner*—Clifford D. Crowder
*Attorney, Agent, or Firm*—Oltsch, Knoblock & Hall

[57] ABSTRACT

A watertight vertically elongated rigid shell or hull of a size small enough to be transportable over highways has a detachable snorkle extending from its top and contains a power source which may be used to drive pumps within the device and/or to drive mechanical devices, such as rotating blades, winches, belts, drills or propellers, which are located externally of the hull. The hull of the device is divided into upper and lower compartments, of which the lower compartment can be completely or partially flooded with water which acts as a ballast helping to stabilize the device and controlling submersion thereof and its submerged position.

15 Claims, 9 Drawing Figures

12
11
13
16
16
16
19
19
19
15
42A
10
22
21
20
20
20
19
19
14
18
77
14
23

12
13
11
16
16
19
19
19
10
22
21
20
20
20
129
130
19
19
132
28
133
128
14
76
26
24
26
25
25
131

12
13
11
10'
51
51
54
54
54
21'
50
53
50
53
50
53
14
52
21
18'
52
52

12
13
11
22
10
21
65
66
65
65

VERSATILE SUBMERSIBLE DEVICE FOR DREDGING OR OTHER UNDERWATER FUNCTIONS

CROSS REFERENCE TO RELATED APPLICATIONS

This application is a continuation-in-part of my prior application for submersible dredging device, Ser. No. 740,117, filed Nov. 8, 1976 and now abandoned; which in turn is a continuation of Ser. No. 651,527, filed Jan. 22, 1976 and now abandoned; which in turn is a continuation of Ser. No. 517,469, filed May 14, 1975 and now abandoned; which in turn is a continuation of Ser. No. 469,930, filed Apr. 15, 1974 and now abandoned; which in turn is a continuation of Ser. No. 369,925, filed June 14, 1973 and now abandoned; which in turn is a continuation of Ser. No. 161,348, filed July 6, 1971, now abandoned.

BACKGROUND OF THE INVENTION

This invention relates generally to a device for ocean offshore and other dredging operations. The inventor calls this device the "STUMP" dredge, a descriptive acronym standing for "submersible transportable utility marine pump." Besides serving as a dredge, the STUMP can accomplish other operations, such as augering, trenching and serving as a pump sub-station or as a base for divers.

The prior art contains devices which have some of the features of the STUMP, but no prior device possesses all of the desirable features and capabilities of the STUMP. Because of the efficiency of the STUMP, due in part to its stability and its containment of its dredge pump within a few feet of the material being dredged rather than at the surface, and because it combines many desirable features within a relatively small transportable device, many underwater operations previously too costly are now economically feasible.

According to the National Shoreline Study begun in 1970 by the U.S. Army Corps of Engineers, about 8% of 37,000 miles of U.S. coastline have eroding beaches which are in "critical" condition. "Critical" condition means that the cost of nourishing the beach is less than the value of the beach and the property it protects. To calculate the cost of beach nourishment against the value of property, a unit cost per cubic yard of sand or other material placed on the beach must be calculated.

Dredging projects have different degrees of difficulty and employ different equipment. Dredging in protected waters can be done at approximately one-fourth the cost of open sea dredging. The large cost differential is due to the down-time of equipment resulting from such causes as inability to operate during bad weather, or standing by for repairs to damage to equipment while operating in rough seas. The STUMP substantially lowers the cost of open sea dredging because the STUMP can operate continuously and nearly as well in rough sea conditions as other dredges operate in protected waters. Such rough water operations are possible because the STUMP is a highly mobile, submersible self-contained dredging device which requires no surface operation or direction when manned, and because the STUMP can take on ballast to lower its center of gravity and submerge it to a selected depth while exposing only a small snorkle to rough water surface conditions.

In 1906, U.S. Pat. No. 813,935 was granted to Avery for a submarine dredge. This dredge was limited in several respects. Its power was supplied through lines from a tender vessel or from shore. It was wheeled, whereas wheels and tracks have generally not proven successful for use in submersible dredges; and it had ballast tanks which were not large enough in comparison to the total volume of the vessel to give the device the stability necessary to operate in heavy offshore wave conditions.

In 1908, U.S. Pat. No. 885,930 was granted to Lake for a dredging device which was much more mobile and controllable than Avery's dredge because it was attached to a tender vessel and to anchor weights by cables, the cables being controlled by winches on the dredge to move it as required. Lake's device was an improvement over Avery in that it had cutting blades that could aid in dredging hard ocean bottoms. However, because Lake's device required attachment to and dependence on a tender vessel at the water surface, as well as direct contact with the ocean bed, structural failures became probable if wave heights increased over about four feet.

In 1908, U.S. Pat. No. 939,227 was granted to Diehle for a variation of the Lake type device. Diehle's device suffered from the same disadvantages mentioned with reference to the Lake device, such as long down-time during rough seas and an over-all inefficient pumping system.

In 1919, U.S. Pat. No. 1,321,562 was granted to Sisson for a submarine vessel designed primarily as a salvaging device. This vessel contained its own power source and had external propellers and rudders for manuevering. However, the device could not take on ballast to change its density and its submerged position, and, since it is lighter than sea water, it required constant operation of a propeller to supply a downward thrust to submerge it and keep it submerged. The device had to be attached to a tender ship by a cable and contained a limited compressed air supply.

In 1934, U.S. Pat. No. 1,948,934 was granted to O'Rourke for a submarine air lock, which, like Sisson's device, was used primarily as a salvage vessel. O'Rourke's device could change its density by lowering weights to the ocean floor, said weights being attached to the device by cables. But the device had no propellers or rudders for manuevering it. O'Rourke's device was constantly dependent upon a surface vessel for a supply of fresh air.

In 1950, U.S. Pat. No. 2,519,458 granted to Goodman disclosed a traveling underwater compressed air working chamber which combined propeller manueverability with the ability to change density, which features made it possible for the device to operate freely from a surface tender vessel. The device was used as a base for divers working in a surrounding underwater area. Since the device had no snorkel and was free of surface attachments, it had a limited compressed air supply. This feature and others limited the usefulness of the device to a temporary base station for divers.

In 1952, U.S. Pat. No. 2,585,712 was granted to Wiggins for a diving apparatus similar to that of Goodman which was quite stable due to the provision of feet which could take on ballast. The device could stay down indefinitely since it received air from the surface, but required a surface vessel to attend it constantly.

In 1968, U.S. Pat. No. 3,369,368 granted to Wilson disclosed a diving structure which combined the features of the Goodman and Wiggins devices. The Wilson device had propellers for manueverability, ballast tanks, and feet to take on ballast for stability. If a tender vessel was present the Wilson device could get air from it, or it could use compressed air in tanks within the device. Wilson's device also provided means for spraying jets of water from feet supporting the device. The jets were used only to free the feet from the bottom after they had settled into the ocean floor. The Wilson device had limited versatility since it could serve only as a base for divers.

As can be seen from this cursory review of the prior art, many different types of underwater devices have been designed, each primarily for some specific type of underwater operation. Each prior device was implicitly limited to the performance of only the operation for which it was designed. Similarly, in each prior device the provision of certain advantageous features therein meant accompanying disadvantages, such as a limited compressed air supply in devices independent of a tender vessel, and ability to achieve a high degree of manueverability only at the expense of limited stability.

SUMMARY OF THE INVENTION

It is the primary object of this invention to provide a device which can efficiently perform several types of underwater functions, such as dredging in deep or shallow water, dredging on hard or soft sea bottoms, acting as a booster pumping station, drilling with an auger, serving as a salvaging vessel, serving as a cable layer, or serving as a base for divers doing underwater work.

Another object of this invention is to provide a device having a high degree of manueverability and stability which can operate attached to or apart from a tender vessel or a shore station, and which is operable with or without a self-contained air source.

Another object of this invention is to provide a versatile submersible device large enough to be manned and small enough to be transportable over highways.

Another object of this invention is to provide a versatile submersible device capable of operating in rough seas.

Another object of this invention is to provide a dredge which is efficient enough to make it economically feasible to nourish any beach needing nourishment.

Another object of this invention is to provide a versatile submersible device useful for the economical accomplishment of many underwater operations previously too costly by known equipment.

Another object of this invention is to provide a versatile submersible device which is capable of movement in all directions while submerged by the selective operation of different manuevering devices, such as propellers, rudders, water jets, ballasts and winches for cables attached to anchor weights.

Another object of this invention is to provide a dredging device capable of cleaning up "hot spots", i.e., areas where spills or accumulations of dangerous toxins, chemicals and heavy metals have occurred at the ocean bottom.

Another object of this invention is to provide a versatile submersible device which can be controlled from within the device manually or can be controlled from a remote location by signals transmitted by radio or electric cables.

These and other objects and advantages will become apparent to those skilled in the art upon reading the details of construction and operation more fully set forth herein below, reference being had to the accompanying drawings forming a part hereof wherein like numerals refer to parts throughout.

Applicant's invention relates to an elongated watertight shell or hull readily transportable by truck, such as a cylindrical unit not greatly exceeding ten feet in diameter and 16 feet in height. From the top of the hull projects a detachable snorkel, preferably approximately three feet in diameter and ten feet in height, to which other sections may be added to extend the snorkel to any selected and required length. A hatch (not shown) may be provided at the base of the snorkel to accommodate use of the upper chamber as a lock-out chamber to contain air and provide passage of a diver into the lower chamber to an escape hatch. When the snorkel is not attached and the snorkel access opening is sealed, air and electrical power may be derived from lines extending from the surface.

The hull is divided into separate upper and lower airtight chambers or compartments, with the upper compartment comprising approximately one-third the volume of the device. Within the upper chamber is located a power source, preferably a gas turbine or a diesel engine in devices having a snorkel. Such power source is connected to an electric generator or a hydraulic pump. Lines lead from the pump or generator, such as lines to carry pressurized hydraulic fluid to power hydraulic motors, and electrical lines to power electric motors, which motors are located in the lower compartment. The hydraulic and/or electric lines contain cut-off or metering valves or switches operated manually from a panel located in the upper compartment, or operated remotely by electro servo controls. The controlled motors drive various mechanisms including:

(1) a dredge pump within the lower compartment which can be controlled for use for dredging, and for flooding and emptying the lower compartment of ballast water, or can be used as a relay pump; (2) a plurality of rotatable propellers or thrusters, preferably four in number, located exteriorly of the hull of the device in circumferentially spaced relation which may be used for manuevering the device; (3) a high pressure water pump for ejecting water in jets from the bottom of the device to agitate and slurry materials to be dredged, and jets from the sides to assist in manuevering the device; (4) blades or cutter heads which cut away and agitate hard bottom material so as to facilitate dredging and to dig trenches for pipes or cables; (5) augers for drilling into the ocean bottom, as for caissons; and (6) winches which pull cables attached to anchor weights and extending in different directions from the device to aid in manuevering the device.

DESCRIPTION OF THE PREFERRED EMBODIMENT

Before the invention is specifically described, it is to be understood that the invention is not limited to the particular arrangement of parts shown and described herein, inasmuch as the construction thereof may vary. It is also understood that the phraseology or terminology herein used is for purposes of description of a particular embodiment and not of limitation, the scope of the invention being denoted by the appended claims.

Figure 1:
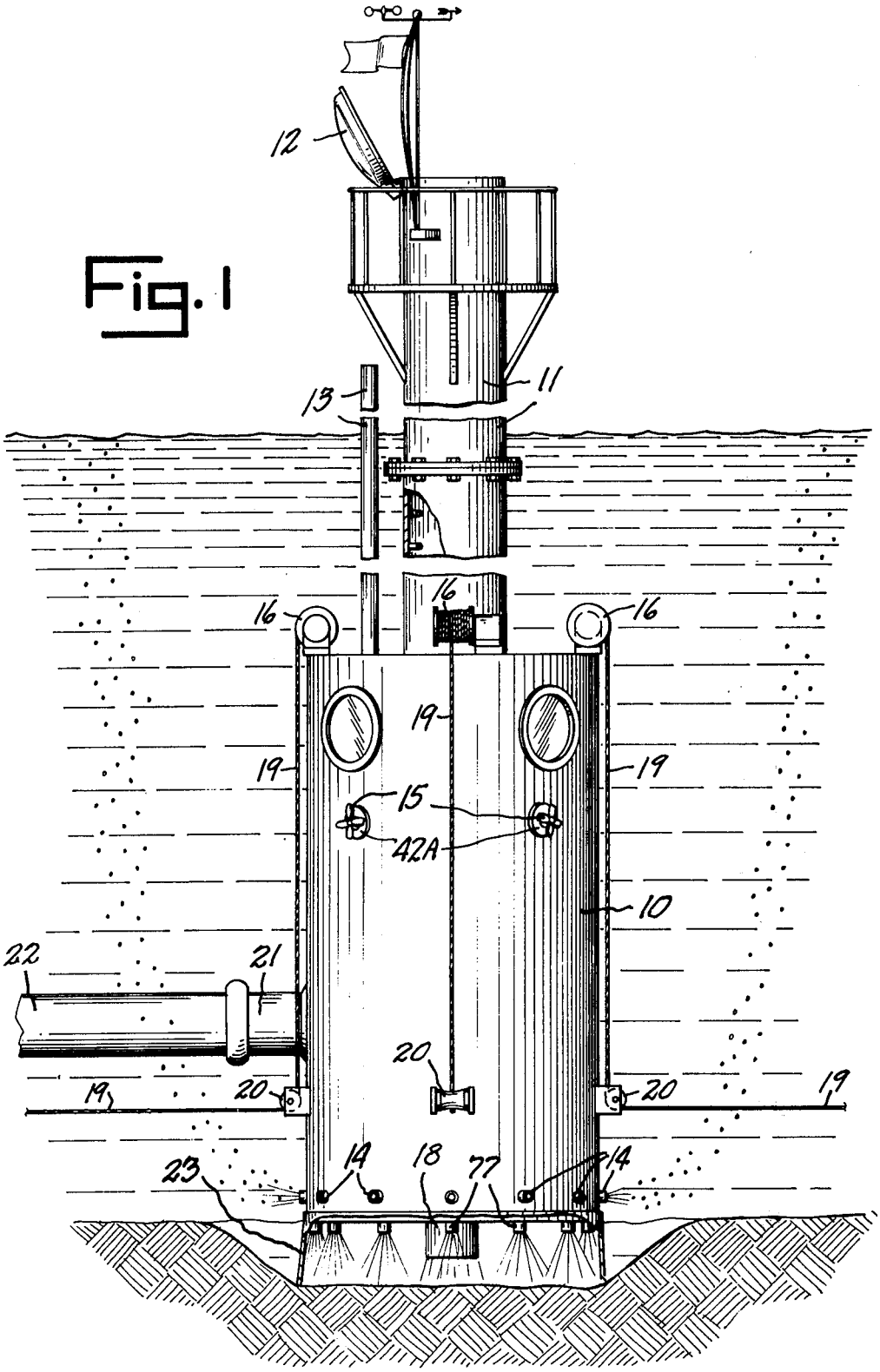
FIG. 1 is a side view showing the device with a snorkel operating as an offshore dredge working on a soft ocean bottom.
Figure 6:
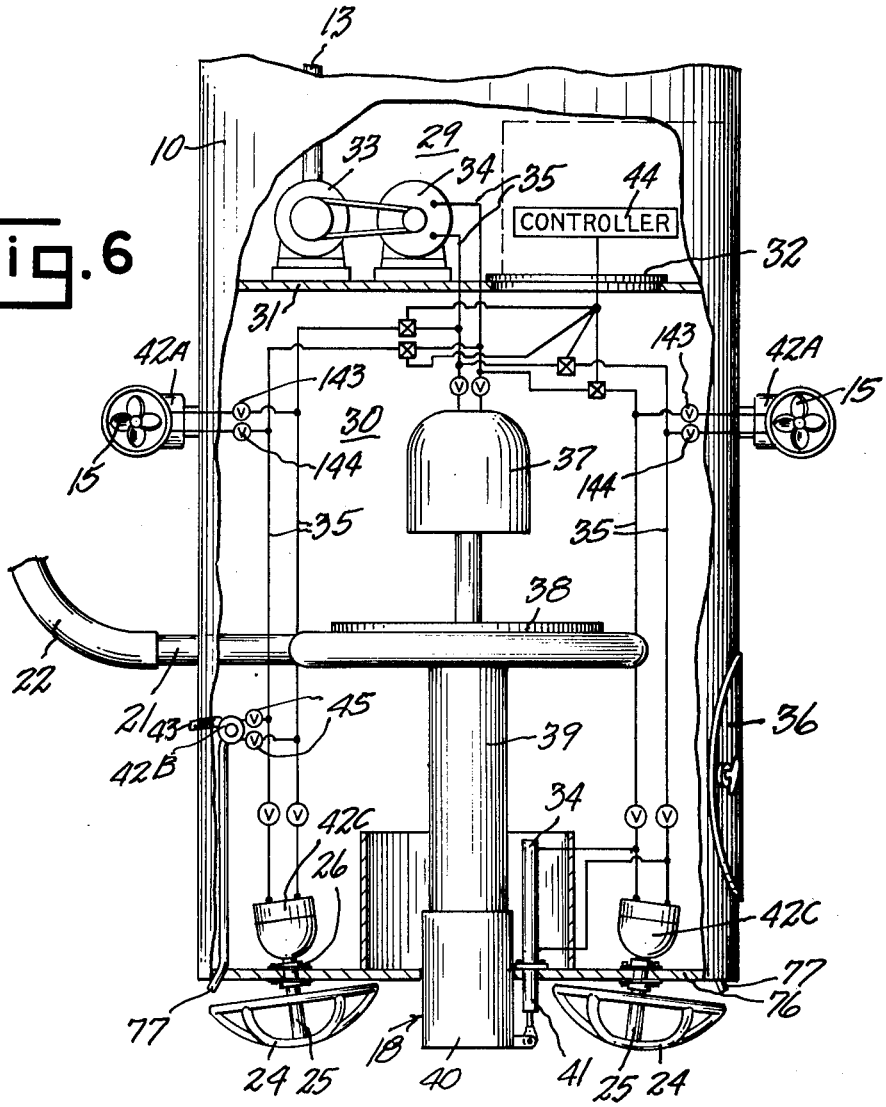
FIG. 6 is a fragmentary view of the device, with parts cut away.

Referring to the drawings, and particularly to FIG. 1, applicant's device is shown underwater in an operating position for use as an offshore dredge. The device has a hollow shell or hull 10 which is preferably cylindrical and may be made of steel plates of a thickness of ¾ to 1 inch. The hull may be stressed in monocoque design. The hull 10 may be reinforced with radial gussets where it supports machinery. The hull is watertight and capable of withstanding large underwater pressures. As seen in FIG. 6, the hull has a sealed partition 31 extending thereacross to provide an upper chamber 29 and a lower chamber 30 therein which are sealed from each other. Partition 31 is provided with a hatch 32. At its upper end the hull has an access opening at which a snorkel type tube 11, preferably approximately three feet in diameter and provided with a hatch 12, is sealingly secured. Also a hatch (not shown) may be provided at the bottom of the snorkel tube. The snorkel tube 11 may be formed of multiple sections secured to each other and to the hull by sealed joints of any suitable construction. Any suitable means within the snorkel tube, such as a ladder (not shown) may provide access to the upper chamber. The snorkel assures an acceptable environment for the crew in the upper chamber. A second snorkel tube 13 preferably approximately three inches in diameter projects from the upper end of the hull with a sealed connection and is connected with an engine 33 contained in the upper chamber 29 for which it serves as an exhaust. Either of the snorkels 11,13 may carry a radio antenna or navigational lights (not shown). Partition 31 is provided with the sealing hatch 32 to allow access between the compartments 29 and 30. The lower compartment 30 may be provided with a sealed hatch 36 to allow access to and from the sea by divers.

The engine 33 may be a gas turbine having a suitable driving connection with a member 34 which may be a hydraulic pump or an electrical generator or other power transmitting device. The power transmitting device 34 is connected by leads 35, such as tubes for pressurized liquid or electric lines, which extend through seals in the partition 31 and into the lower chamber 30. The leads 35 extend to different devices within the lower chamber to provide power for operating the latter.

A large motor 37, either hydraulic or electrical, is mounted in the lower chamber substantially on the vertical axis of the hull and is connected to the lines 35 to be operated and controlled from a control panel 44 within the upper chamber 29. The motor 37 has a shaft substantially coaxial with the hull and serves to drive a pump 38 having an intake conduit 39 which communicates with an intake 18 projecting below the bottom wall 76 of the lower chamber 30. The intake 18 may include a telescopic section 40 which can be extended or retracted relative to the bottom wall 76 of the shell, as by means of a hydraulic piston 41 powered by hydraulic pump 34 through some of the branch lines 35. Pump 38 is provided with an outlet conduit 21 projecting laterally from the hull 10 and adapted for connection with a discharge conduit 22 extending to a selected point of discharge of dredged material.

Figure 2:
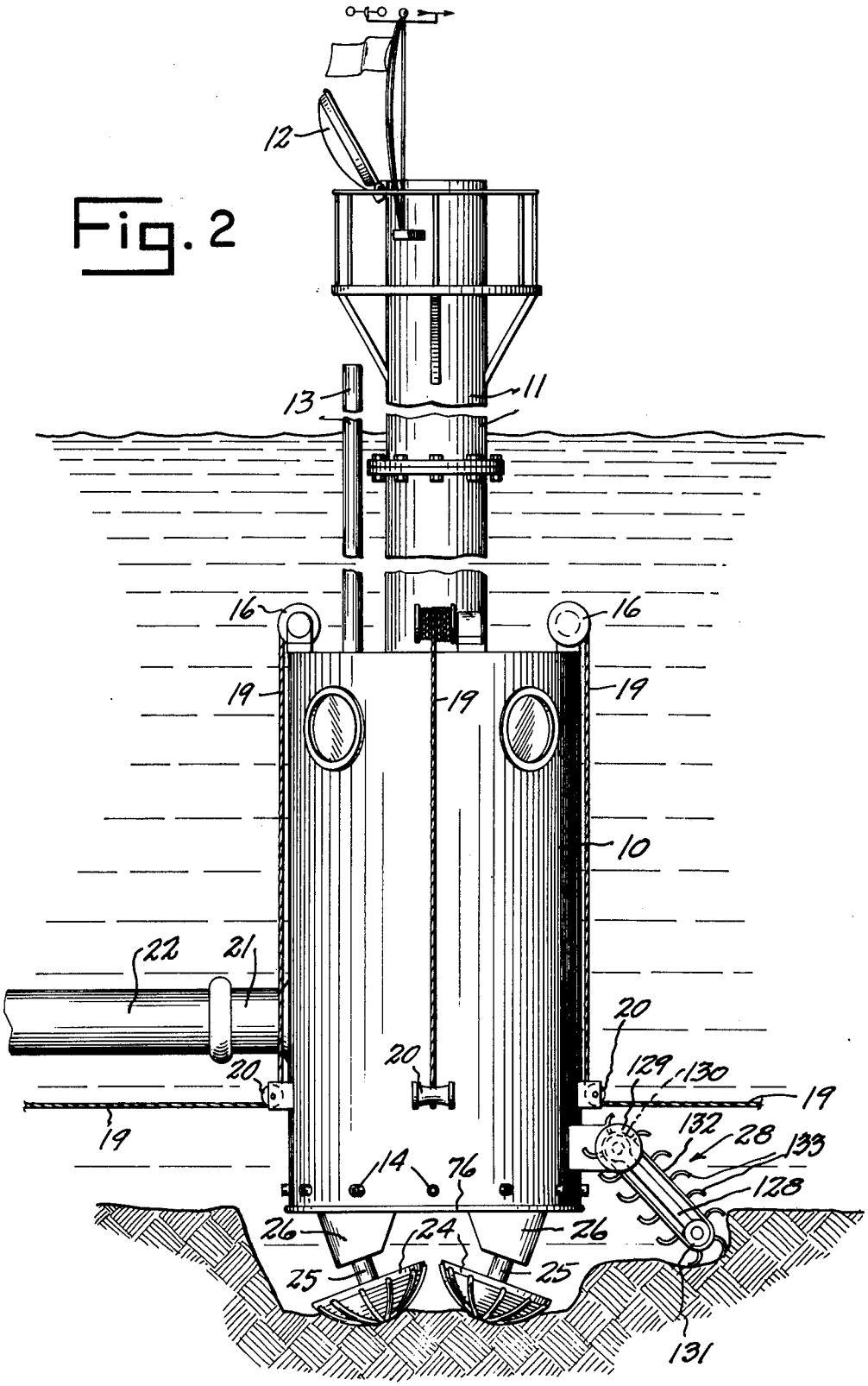
FIG. 2 is a side view showing the device with a snorkel in operation as an offshore dredge working on a hard ocean bottom.
Figure 3:
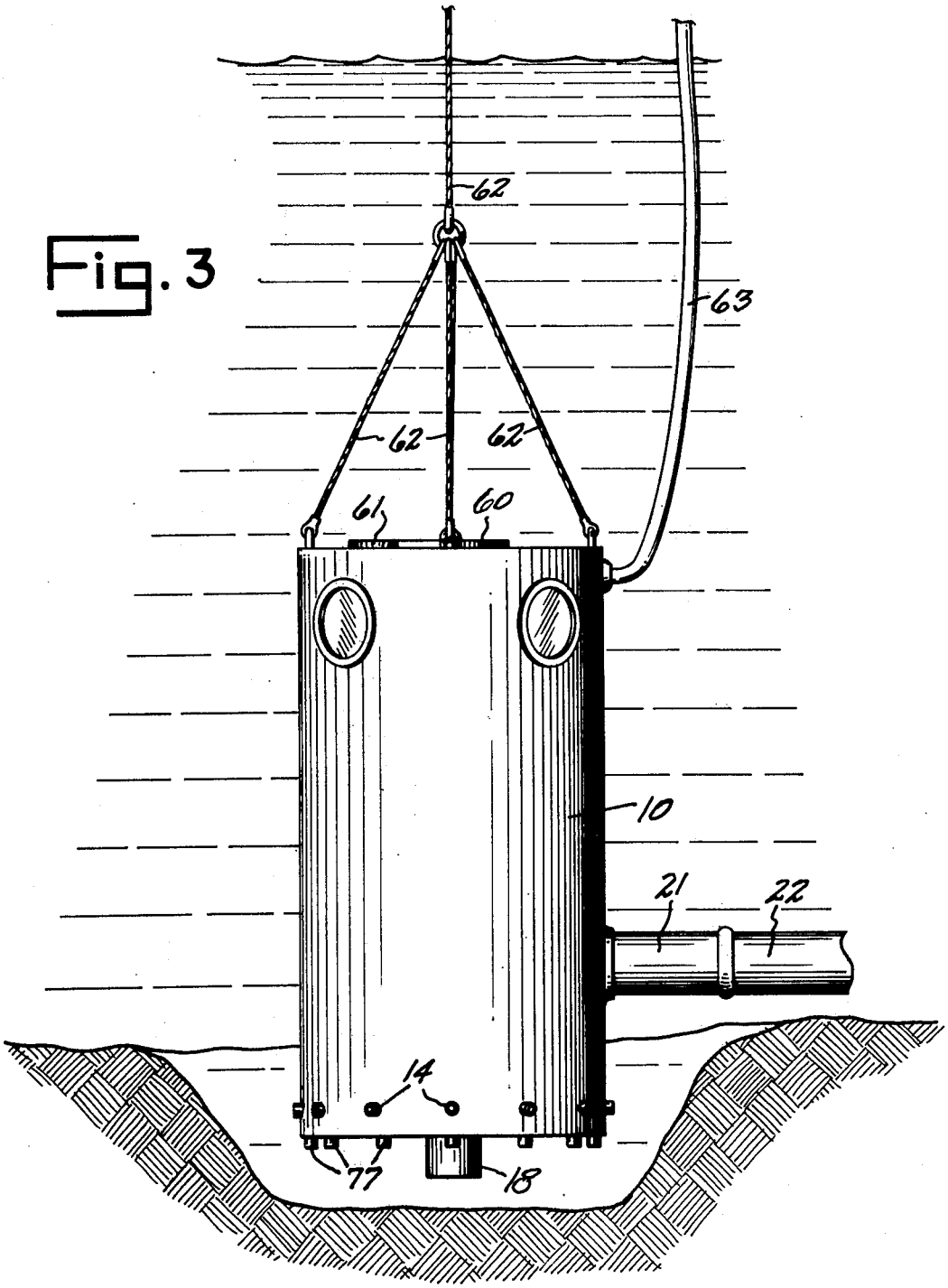
FIG. 3 is a side view showing the device without a snorkel operating as a deep water dredge working on a soft ocean bottom.
Figure 8:
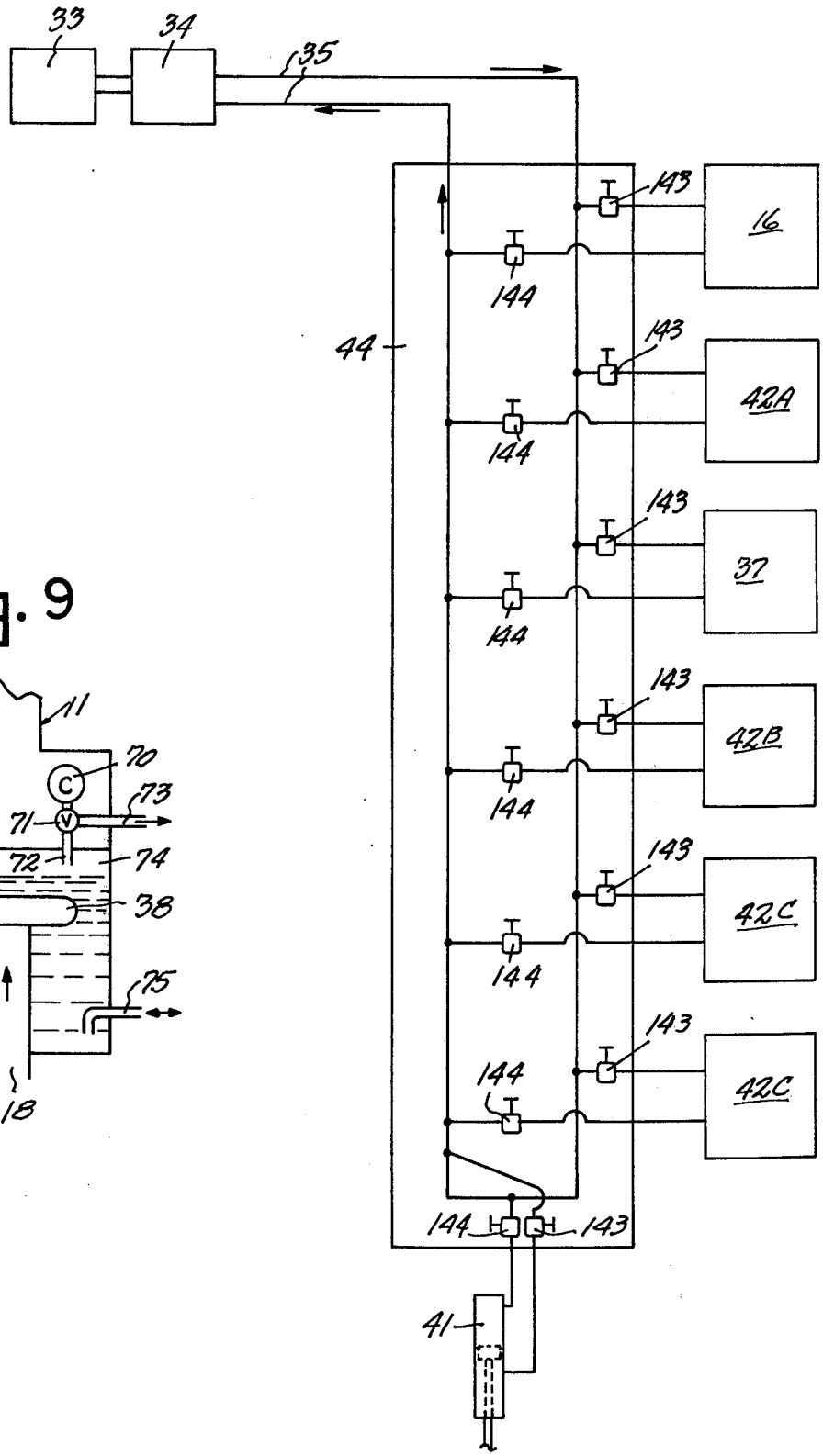
FIG. 8 is a diagram of a control system for the device.

As illustrated in FIGS. 1, 2 and 3, a plurality of jet outlets are located at the lower portion of the hull. The jet outlets include outlets 14 spaced around the hull at the lower portion of the side walls thereof and directed laterally or outwardly from the hull at selected angles. Also, a plurality of jet outlets 77 project from the bottom 76 of the hull in spaced relation. A detachable skirt 23 may be connected to the hull at the lower portion thereof, as between the two sets or series of jets 14 and 77, the same preferably being of a dimension to project beyond the outermost extension of the pump intake 18,40 and the jet outlets 77. Each of the jet outlets 14 and 77 will preferably be connected to the outlet of the pump 38 or to any other pump capable of generating in said jet outlets, or in selected ones thereof as determined by suitable control means, powerful jets of liquid. The liquid jetted from outlets 77 is capable of dislodging and loosening components on the ocean bed and the liquid jetted from selected outlets 14 is capable of assisting in lateral manuevering the hull. In FIG. 6 is schematically illustrated an auxiliary pump for ejecting water jets at the outlets 14 and 77, wherein one or more motor driven pumps 42B are connected with lines branching from lines 35, and provided with suitable control valves 45 as illustrated in FIG. 8, which have outlets connected with the jet outlets 14 and 77 and an inlet 43 which is suitably screened and projects laterally from the hull.

The hull 10 may mount externally thereof, as at a mid-height position, a plurality of spaced propellers 15 peripherally spaced about the hull, preferably four propellers equally spaced circumferentially of the hull and oriented in different directions. The propellers 15 may be driven by fluid motors 42A connected selectively with power lines 35 and controlled selectively by controls 143 and 144 associated with controller 44 and positioned in lines branching from the power lines 35. Selective operation of the propellers 15 provides means for manuevering the hull on the ocean bottom laterally, or rotatively about a vertical axis.

Figure 7:
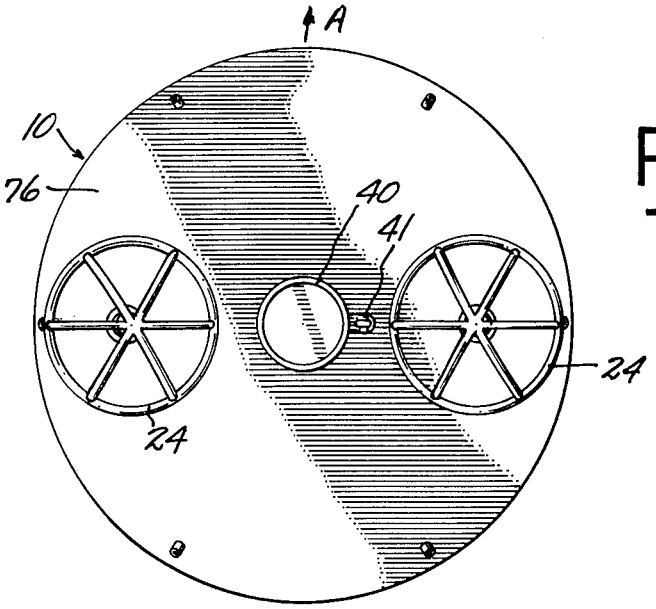
FIG. 7 is a bottom view of the device.

FIGS. 2, 6 and 7 illustrate a construction in which cutting blades 24 mounted on shafts 25 journaled in suitable bearings 26 carried by the bottom wall 76 of the hull are operated by motors 42C which derive power from branch lines 35 and are selectively controlled from the controller 44. The blades 24 project below the bottom 76 and preferably are used to loosen soil, sand or sediment at the sea bottom and mix it with surrounding water for entrainment in dredged material drawn into the pump 38 and discharged through the lines 21 and 22. In this arrangement, as illustrated in FIG. 2, the skirt 23 shown in FIG. 1 is preferably omitted. The cutters 24 are preferably arranged at opposite sides of the bottom of the hull and preferably rotate in opposite directions so that their rotation does not cause the hull to rotate. Each of the blades 24 is preferably angled downwardly and inwardly along its rotational axis and is clear of the pump intake 18. This arrangement provides for movement of the shell in the direction of the arrow A shown in FIG. 7.

Alternatively, a different type of cutter, such as the cutter 28 shown in FIG. 2, may be employed when the device is being used to dig a trench. Cutter 28 is preferably of the type wherein an elongated arm 128 is pivoted externally of the hull on a substantially horizontal axis, the pivot axis being the axis of a suitable drive motor 129 carried by the hull and driving a sprocket or pulley 130. A sprocket or pulley 131 is journaled in the free end of the arm 128 and a chain or belt 132 is trained around said pulleys or sprockets and mounts a plurality of scoops or digging elements 133. Motor 129 is powered from power lines 35 under the control of controller 44 in place of or in the same manner as motors 42C are controlled.

Figure 9:
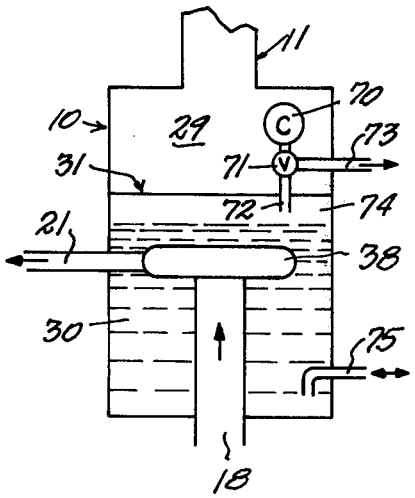
FIG. 9 is a schematic illustration of an air control system for the device.

Control of the ballast of the device, that is, the amount of water admitted into the lower chamber 30 for ballast purposes, is illustrated schematically in FIG. 9. In this construction an air compressor 70 is mounted in the upper chamber and suitably powered. A valve 71 may be selectively adjusted to discharge compressed air into the upper portion of the lower chamber 30 at air space 74 to lower the level of liquid within the chamber 30, as by forcing the same through an outlet 75 in the lower portion of the lower chamber 30. Alternatively, the valve 71 may be adjusted to accommodate discharge of air from air space 74 through lines 72 and 73 so as to permit the water level within the chamber 30 to rise incident to intake of water at 75. In a third position of the valve 71, it is maintained closed, thereby maintaining a selected amount of ballast water within the lower chamber as controlled by the amount of air in the air space 74.

A plurality of power driven winches 16 are mounted upon the hull at the upper outer portion thereof. Preferably four winches equally spaced are utilized, and each has a connection with a cable 19 which may be paid out or taken up depending upon the direction of rotation of the winch under selective control from the controller 44. A pulley 20 is journaled at the lower portion of the hull 10 below the center of buoyancy of the hull and preferably below each associated winch 16. The pulleys 20 accommodate lateral extension of the cables 19 in selected directions to extend to anchoring weights (not shown) positioned upon the sea bottom or other support spaced from the hull. It will be apparent that selective operation of the winches 16 will permit lateral movement of the hull in any selected direction.

The function of the controls for the various elements is illustrated schematically in FIG. 8 in which the control 44 is provided with a plurality of valve members 143 and 144 which are selectively operable and each of which is associated with one of the operating components of the device, such as a winch 16, a propeller operating motor 42A, main motor pump 37, auxiliary jet control pump motor 42B, a cutter motor 42C and the intake adjusting piston 41. Each valve controls hydraulic pressure through a selected one of the hydraulic lines 35 from the power source 33,34.

The jets 14 and 77, propellers 15, winches 16 and control valve 71 provide means to stabilize the hull and to manuever it in all planes. Thus some of the jets 14 may discharge streams of water in controlled directions to create a thrust, manuever and stabilize the hull. The propellers 15 may be selectively operated to create thrust which helps manuever and/or stabilize the hull. Similarly the winches 16 may be selectively operated to exert a force below the center of buoyancy of the hull so as to utilize the cables and the anchors connected thereto at distances such as 1,000 feet from the hull to stabilize the hull in swift currents, during tidal changes, and to assist in swinging the hull from right to left and forward and backward when the hull is working over an area as a dredge. It will be understood that the anchors of the cables 19 may be attached to surface vessels or to the shore, rather than to anchor weights.

Referring to FIG. 1 which illustrates the use of the device as a dredge, material from the sea bed is drawn through intake 18 by the pump 38 and is discharged at the outlet 21 for distribution by the conduit 22 which may extend to any selected discharge position. The discharges of water jets from the jet outlets 77 at the bottom of the shell serve to agitate the sea bed to loosen sand and soil and other material for entrainment in water being drawn into the inlet 18 of the dredge pump 38.

Figure 4:
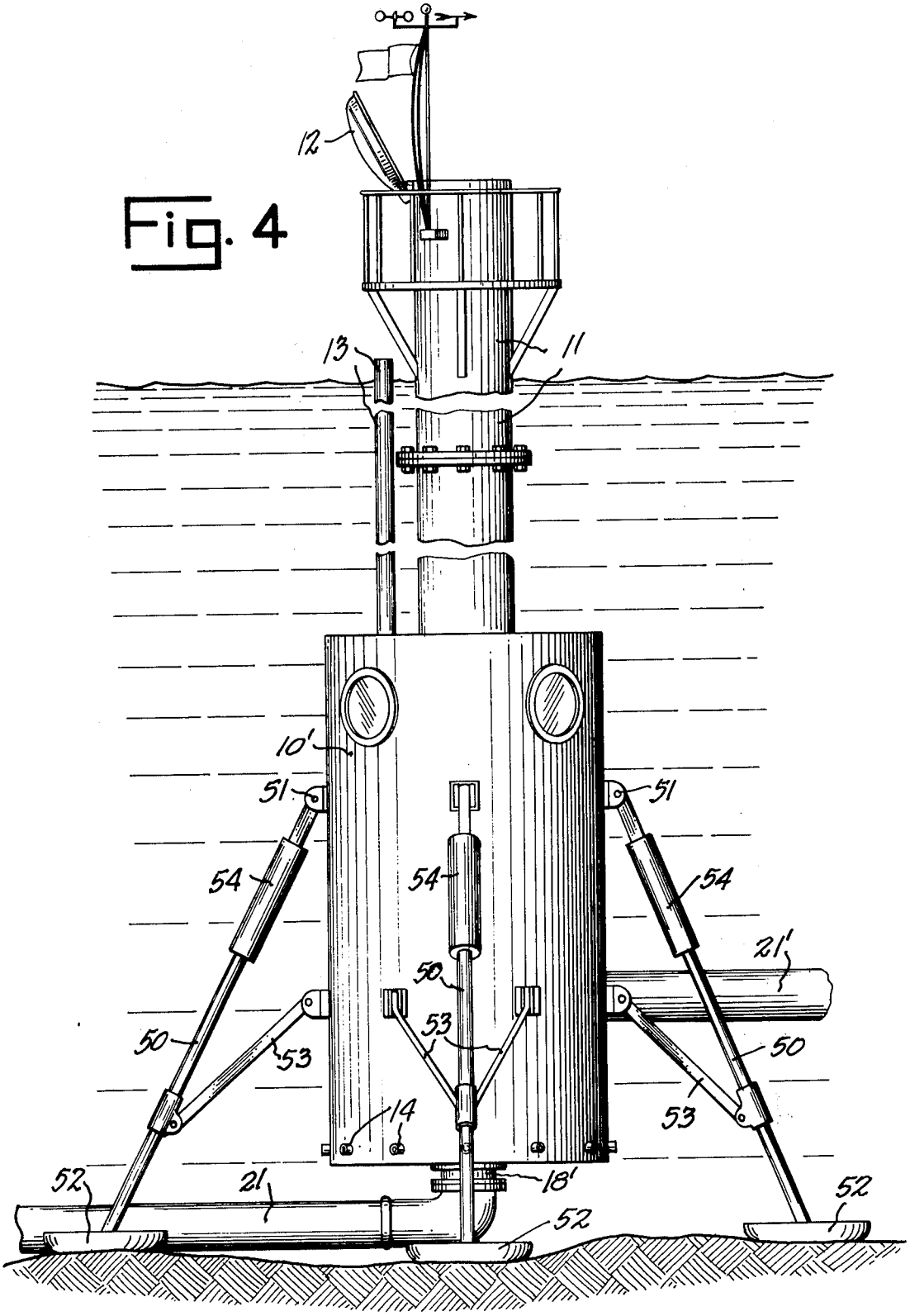
FIG. 4 is a side view showing the device with a snorkel and detachable legs mounted thereon and serving as a booster station.

If the distance from the device to the desired discharge point is too great for the efficiency of the pump 38, another STUMP device can be connected to the outlet 21 and used as a booster pump, as shown in FIG. 4, wherein line 21 is connected to the intake 18' of a hull 10' and a pump within that hull (not shown) discharges through a conduit 21'. When a STUMP device is used as a booster pump as shown in FIG. 4, it is preferably provided with detachable collapsible legs 50 projecting at different angular positions from the shell and pivoted at 51. The legs 50 may have foot portions 52, pivoted supporting braces 53 and suitable means 54 for adjusting the length thereof.

Referring again to FIG. 1, the skirt 23 may be formed of rigid or flexible material and so constructed that it contacts the sea bottom in the area around the hull and therebelow. The skirt 23 preferably is formed of material which serves to retain material from the sea bed which is being slurried by the operation of the pump 38. It will be noted that skirt 23 is preferably not utilized when the cutting blades 24 are attached to the device as illustrated in FIG. 2, as may be desirable in uses of the device in areas where the sea bed is hard or contains crusty materials so that a greater force than can be generated by jets discharged at 77 provide. Similarly, the skirt 23 is not utilized when a trenching attachment 28 as illustrated in FIG. 2 is provided or utilized.

FIG. 3 illustrates a modification of the device for use as a deep water dredge. For this usage snorkels 11 and 13 are removed and hatches 60 and 61 are mounted to seal the respective snorkel openings. Cables 62 are connected to the upper end of the hull to permit suspension of the unit from a tender vessel (not shown). In this instance, the power source 34 may be electrical and electrical leads may be extended to the power source and to the control 44 through an elongated flexible waterproof conduit 63 leading to a tender vessel (not shown). It will be understood that the use of skirt 23, cutters 24, and trenchers 28 are optional, and may be provided in the unit when used as a deep sea dredge as illustrated in FIG. 3.

Figure 5:
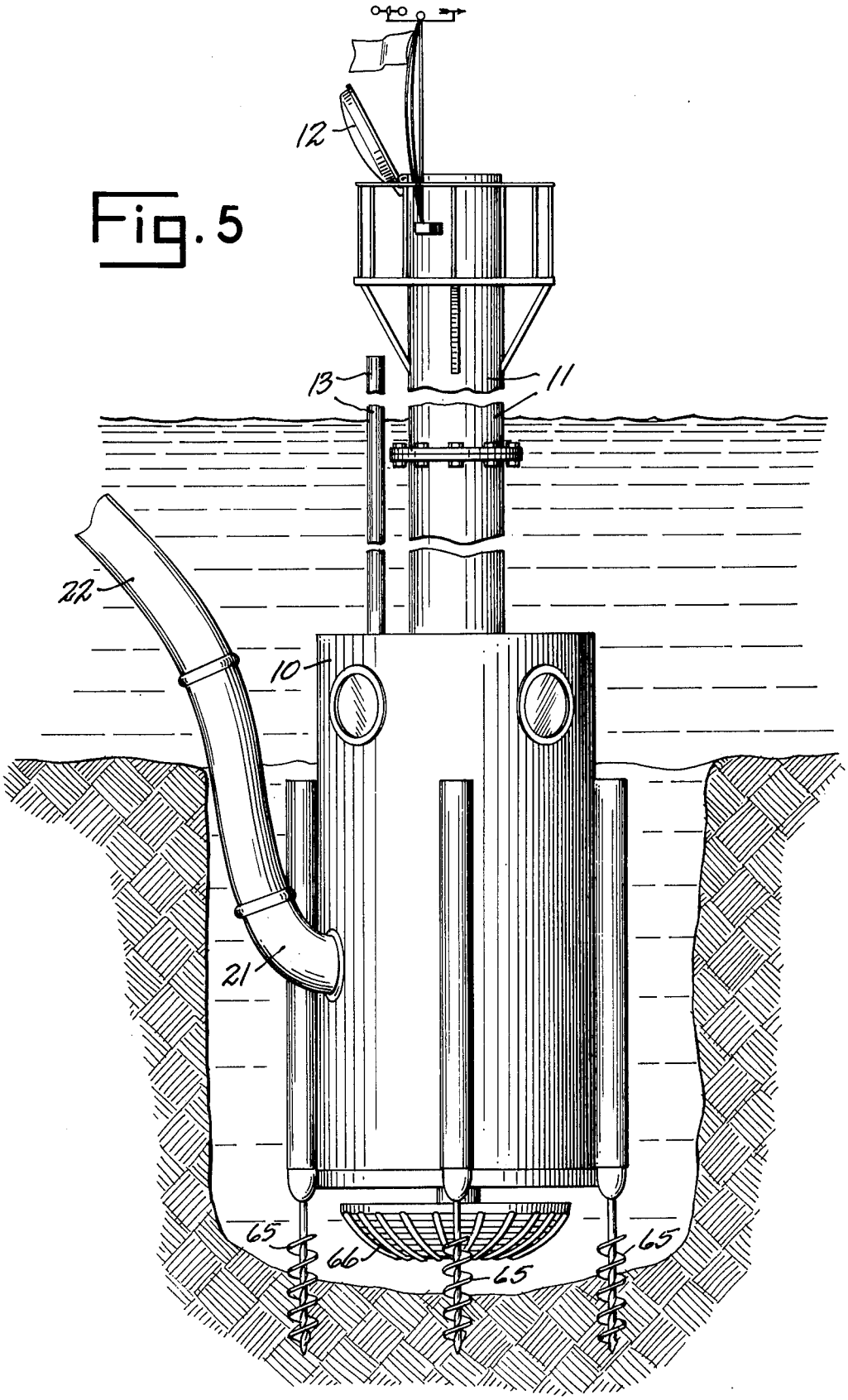
FIG. 5 is a side view showing the device provided with augers.

FIG. 5 illustrates another usage of the device. In this instance a plurality of augers 65 are carried by and project below the hull at the sides thereof, being suitably mounted thereon and provided with means (not shown) by which the augers may be rotated, such means being suitably powered by the motor 33 or other power source and controlled by the controller 44. Also a cutter 66 may be positioned below the hull 10 and substantially centrally thereof and between the augers 65. This usage of the device permits the anchorage of the hull 10 in hard ocean floor material at a selected position incident to lowering thereof, as by progressive increase of the amount of liquid ballast in the lower chamber 30. In this usage of the device it can be used to aid in such functions as drilling for oil, as by passing a drill (not shown) through the snorkel and the hull 10 and into the ocean floor. Such usage of the STUMP can aid in the prevention and/or containment of oil blowouts, and preferably entails removal or displacement of the pump 38 after the device has been anchored in the ocean floor preliminary to the lowering of a drill (not shown) through the device, as through passage of a drill casing (not shown) through a central opening in the partition 31.

The control of the amount of ballast admitted to the lower chamber permits control of the depth of submersion of the device in the water. Thus as ballast water is admitted to the lower chamber 30 through the mechanism illustrated schematically in FIG. 9, the vertical position of the device in relation to the floor of the sea bed can be controlled, regulated and maintained. Maintenance of the position of the hull above but adjacent to the sea bed at the area being worked upon, so that the intake 18 may be clear of the bed and the jet discharges 77 may be clear of the bed, is required in the operations or uses pictured in FIGS. 1 and 3. In other uses, such as those pictured in FIGS. 2, 4 and 5, the position of the unit may be such that it is fully submerged so that elements thereof such as the cutters 24 in FIG. 2, the feet 127 of the struts 26 shown in FIG. 4, and the augers 27 shown in FIG. 5, may engage or bear upon the sea bed after submersion to an extent or with a force as required for functioning of the cutters, augers, etc. It will be understood that the mechanism schematically shown in FIG. 9 permits the return of the hull to the surface as compressed air is progressively forced into the chamber 30 to reduce the ballast thereof and achieve a condition in which the hollow hull 10 becomes buoyant. Also, the mechanism schematically shown in FIG. 9 permits reduction of the ballast to position the hull clear of the sea bed for manuevering thereof by the propellers, winches or jets.

The control 44 of the device includes valves 143 and 144, as seen in FIG. 8, associated with each of the controlled hydraulic units, such as winches 16, propeller motors 42A, supplemental pump 42B, cutter motor 42C, main pump motor 37, hydraulic cylinder 41 and the control for valve 71 shown in FIG. 9. The valves 143 and 144 will be operable at the control panel 44 to permit each of the respective motors for accessories to be individually controlled. Where the motors for accessories are hydraulic, two lines extending from the main supply line 35 enter and exit each motor, and valves 143 and 144 together with appropriate check valves (not shown) may be used to provide control of the direction of rotation of the associated motor where reverse operation is desired.

While the preferred embodiments of the invention have been illustrated and described, it will be understood that changes in the construction of the device may be made within the scope of the appended claims.

What I claim is:

1. A submersible device comprising a hollow hull having at least one watertight partition to divide the hull into an upper watertight chamber and a lower chamber adapted to receive selected amounts of water as ballast and having a bottom wall, means in said upper chamber to generate power, a dredge pump within the lower chamber driven by power from said generating means, intake means connected to said pump and projecting through the bottom of the hull, an elongated discharge conduit connected to said pump and projecting externally of said hull, compressed air means in said upper chamber selectively controllable to discharge air under pressure into the upper part of the lower chamber and discharge water from the lower chamber to control the level of water in the lower chamber or to vent air from the lower chamber and admit water into the lower chamber, and thereby control the depth of submersion of the hull, a plurality of members located in spaced relation transversely of said hull actuable by said generating means and each operable to shift the position of said hull in a predetermined direction, and means for selectively controlling said hull shifting means to position said hull at desired location and relation to the submerged surface being dredged.

2. A submersible device as defined in claim 1, wherein said hull is vertically elongated and substantially symmetrical relative to its vertical axis.

3. A submersible device as defined in claim 1, and a snorkel tube projecting upwardly from said hull and selectively open at said upper chamber.

4. A submersible device as defined in claim 3, wherein said power generating means includes an internal combustion engine, and a snorkel tube connected to the exhaust outlet of said engine and projecting upwardly from said hull.

5. A submersible device as defined in claim 1, and means for ejecting water jets from the bottom of said hull adjacent said pump inlet when submerged to dislodge and loosen components from the water bottom being dredged for entrainment at said pump inlet.

6. A submersible device as defined in claim 5, and a skirt projecting downwardly from said hull outwardly of said jet ejecting means.

7. A submersible device as defined in claim 1, and power actuated cutters projecting from and journaled in the bottom wall of said hull and actuated by said power generating means.

8. A submersible device as defined in claim 1 wherein said hull shifting means include means for ejecting water jets laterally from the lower portion of said hull in selected direction to move said hull laterally when submerged.

9. A submersible device as defined in claim 1 wherein said hull shifting means includes a plurality of selectively operable power actuated propellers projecting from said hull and actuated by said power generating means, each propeller actuable to shift said hull in a selected direction while submerged.

10. A submersible device as defined in claim 1, wherein said hull shifting means include a plurality of selectively operable power actuated cable winches projecting from said hull in peripherally spaced relation and actuated by said power generating means, a pulley journaled adjacent and below each winch exteriorly of said hull, and a cable wound on each winch and trained around the pulley associated with said winch and adapted to extend to anchoring means spaced laterally from said hull.

11. A submersible device as defined in claim 1, and a plurality of spaced collapsible footed leg members adjustably carried by the hull at peripherally spaced locations and projecting below the hull, and means driven from said power generating means for adjusting said leg members.

12. A submersible device as defined in claim 1, and a plurality of power driven devices carried by said hull and adapted to be actuated by said power generating means, and selectively operable control means located in said upper chamber for selectively actuating said power driven devices.

13. A submersible device as defined in claim 1, and a plurality of substantially vertical power driven selectively operated augers carried by and projecting below said hull and actuated by said power generating means.

14. A submersible device as defined in claim 1, and a second substantially similar submersible device spaced from said first named hull, the discharge conduit from said first named pump being connected to the pump intake means of said second device, and, means for positioning said second device on the sea bed spaced from said first device when submerged.

15. In combination in a submersible dredge, a hull having top, bottom and side walls and a partition spanning the hull to separate an upper and a lower chamber therein, means for maintaining a habitable atmosphere in said upper chamber, means for regulating the amount of water ballast within said lower chamber, a dredge pump in said lower chamber, intake and discharge conduits connected to said pump and opening exteriorly of said hull, a plurality of means for propelling said hull spaced peripherally thereof and each functioning to propel said hull in a selected lateral direction, means in said upper chamber for generating motive power for said pump, propelling means, and ballast regulating means, and means selectively controlling said power generating means, pump, propelling means and ballast regulating means whereby said ballast regulating means control the location of said hull with respect to the depth of submersion of said hull, and the clearance between the hull and the underwater surface to be dredged and, said propelling means control the direction and extent of movement of the hull as a dredging operation proceeds.

* * * * *